US007293768B2

(12) United States Patent
Satoh

(10) Patent No.: US 7,293,768 B2
(45) Date of Patent: Nov. 13, 2007

(54) IMAGE FORMING APPARATUS

(75) Inventor: Koichi Satoh, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 530 days.

(21) Appl. No.: 10/375,067

(22) Filed: Feb. 28, 2003

(65) Prior Publication Data

US 2004/0046314 A1 Mar. 11, 2004

(30) Foreign Application Priority Data

Sep. 9, 2002 (JP) ..... 2002-263008

(51) Int. Cl.
*B65H 7/02* (2006.01)

(52) U.S. Cl. ..... 271/258.01; 271/265.01

(58) Field of Classification Search ..... 271/256, 271/258.01, 259, 258.02, 258.03, 258.04, 271/265.01, 265.02, 265.03, 261, 264
See application file for complete search history.

(56) References Cited

U.S. PATENT DOCUMENTS 3,693,969 A * 9/1972 Sakamaki et al. ..... 271/259
4,022,460 A * 5/1977 Pritchett ..... 271/258.03
5,316,289 A * 5/1994 Matsuo ..... 271/258.03
5,639,171 A * 6/1997 Brewster et al. ..... 400/708
5,655,207 A * 8/1997 Sugiyama et al. ..... 399/382
6,053,495 A * 4/2000 Hara et al. ..... 271/263
6,076,821 A * 6/2000 Embry et al. ..... 271/10.01
6,311,972 B1 * 11/2001 Carter ..... 271/265.02
6,322,069 B1 * 11/2001 Krucinski et al. ..... 271/265.02
6,502,818 B1 * 1/2003 Nonaka et al. ..... 271/258.01
6,644,660 B2 * 11/2003 Sussmeier et al. ..... 271/270
6,702,274 B1 * 3/2004 Otsuka ..... 271/10.01
6,758,471 B2 * 7/2004 Hirako ..... 271/258.01

FOREIGN PATENT DOCUMENTS

JP 08245003 A * 9/1996
JP 08245047 A * 9/1996
JP A 8-245003 9/1996
JP A 10-338405 12/1998
JP A 2001-19253 1/2001

* cited by examiner

*Primary Examiner*—Patrick Mackey
*Assistant Examiner*—Thomas Morrison
(74) *Attorney, Agent, or Firm*—Oliff & Berridge PLC

(57) ABSTRACT

Disclosed is an image forming apparatus allowing travel of a tabbed sheet, in which even when a tabbed sheet is made to travel, no erroneous jamming detection occurs, thus allowing the tabbed sheet to travel in the same manner as in the case of an ordinary sheet. The image forming apparatus includes: a sheet detecting unit arranged in a sheet transport path for transporting a sheet and adapted to detect the sheet; and a control unit which, when the tabbed sheet is made to travel, performs control so as to make a set value for a reference timer for a jamming judgment to be made through detection of a sheet by the sheet detecting unit different from a set value for an ordinary sheet.

5 Claims, 9 Drawing Sheets

(A)

(B)

(A)

(B)

(A)

(B)

IMAGE FORMING APPARATUS

FIELD OF THE INVENTION AND RELATED ART STATEMENT

This invention relates to an image forming apparatus, such as an electrophotographic copying machine, a printer, a facsimile, or a multifunction apparatus consisting of a combination of these apparatuses and, inparticular, to an image forming apparatus capable of forming an image on a sheet having a tab.

Conventionally, there has been available an image forming apparatus, such as an electrophotographic copying machine, a printer, a facsimile, or a multifunction apparatus consisting of a combination of these apparatuses which allows transport of a sheet having a tab (hereinafter referred to as a "tabbed sheet"). The length of a tabbed sheet in the sheet transport direction is larger than that of an ordinary sheet by the length of the tab. Further, with a tabbed sheet, the tab is situated on either the upstream side or the downstream side with respect to the sheet transport direction. Thus, in an image forming apparatus as mentioned above, transporting a tabbed sheet in the same manner as in the case of an ordinary sheet gives rise to various problems. Accordingly, in such an image forming apparatus, it is necessary to change the way the tabbed sheet is transported according to the condition of the tabbed sheet.

In order to eliminate the various problems involved when transporting a tabbed sheet in an image forming apparatus as mentioned above, several techniques have been proposed in JP 8-245003 A, JP 10-338405 A, JP 2001-19253 A, etc.

JP 8-245003 A discloses a sheet feed timing control device for an image forming apparatus in which the sheet feed interval for tabbed sheets is made longer than that for ordinary sheets, thereby compensating for the reduction in sheet feed interval by the length of the tab.

More specifically, JP 8-245003 A discloses a sheet feed timing control device for an image forming apparatus of the type in which when feeding sheets to a sheet transport path, switching is selectively effected between a first sheet accommodating portion accommodating first sheets for ordinary sheet transport and a second sheet accommodating portion accommodating second sheets for a sheet transport taking more time than the ordinary sheet transport, the sheet feed timing control device including: a sheet feeding unit for feeding the first sheets at a second sheet feed interval longer than a first sheet feed interval, a switching command unit which issues a command for switching between the first and second sheets, and a sheet feed adjusting unit which, when a command for switching between the first and second sheets has been issued, causes the first sheet after the issue of the switching command to be fed at the sheet feed interval for the previously fed sheet.

JP 10-338405 A discloses a sheet reversing device in which the position of a stopper of a reverse transport portion is shifted downwardly by the length of a tab.

More specifically, JP 10-338405 A discloses a sheet reversing device of the type in which a sheet received at an inlet guide portion is guided to a reverse guide portion to be fed therefrom to an outlet portion in a state in which it is reversed with respect to the sheet transport direction to thereby reverse the sheet, in which the reverse guide portion is provided with a stopper for varying the position of a sheet according to its size, and when a tabbed sheet is passed, the stopper is controlled according to the length of the tab of the tabbed sheet.

JP 2001-19253 A discloses a sheet reversing device in which the reversing start timing is delayed.

More specifically, JP 2001-19253 A discloses a sheet reversing device which is capable of transporting a tabbed sheet having a tab portion protruding from an end edge thereof, including a transport roller formed of plural rollers mounted to a roller support shaft at intervals in a skewer-like fashion, a reverse branching claw rotationally urged so as to cause a forward end portion side thereof to enter between the plural adjacent rollers, and a reverse transport unit for transporting a sheet transported while being pressed against the transport roller by the reverse branching claw to pass by the reverse branching claw in a direction reverse to the direction of transport by the transport roller, in which when the trailing end of the sheet transported by the transport roller passes the reverse branching claw, the reverse branching claw swings toward the roller support shaft side to thereby guide the sheet reverse-transported by the reverse transport unit to a reverse send-out path by the reverse branching claw. The device is structured such that one of the plural rollers mounted to the roller support shaft is arranged so as to be in correspondence with the tab portion of the tabbed sheet when it is transported with the tab portion at the trailing end with respect to the transport direction, and that the reverse branching claw is arranged at a position where the tab portion is pressed against the transport roller to impart the transport force of the transport roller to the tab portion.

However, the above-mentioned techniques in the prior art have the following problems. In the techniques disclosed in JP 8-245003 A, JP 10-338405 A, JP 2001-19253 A, etc., the sheet feed interval for tabbed sheets is made longer than that for ordinary sheets to thereby compensate for the reduction in the sheet interval by the tab length, or the stopper position of the reverse transport portion is shifted downwardly by the length of the tab, or the reverse start timing is delayed, whereby even a tabbed sheet can be transported without any trouble.

It is to be noted, however, that in the sheet transport system of the above-mentioned image forming apparatuses, there is installed at a predetermined position a sensor for monitoring to see whether the sheet is being transported in the normal fashion or not. When a tabbed sheet passes the position of this sensor, it takes longer for the sensor to detect the sheet than in the case of an ordinary sheet by the length of the tab. As a result, it is erroneously determined that jamming has occurred.

In the sheet reversing device disclosed in JP 10-338405 A, in which the reverse stop position is shifted, the sheet transport timing after the sheet reversing is delayed by the shift amount of the reverse stop position. As a result, with the same detection timing as that for ordinary sheets with no tabs, the sheet will be erroneously judged to have jammed.

OBJECT AND SUMMARY OF THE INVENTION

This invention has been made with a view toward solving the above-mentioned problems in the prior art, and provides an image forming apparatus capable of transporting a tabbed sheet, in which even when a tabbed sheet is transported, no erroneous detection of jamming occurs, making it possible for a tabbed sheet to be transported in the same manner as in the case of an ordinary sheet.

In view of the above circumstances, according to an aspect of the present invention, an image forming apparatus allowing travel of a tabbed sheet equipped with a tab protruding from an end edge thereof of the present invention is characterized by including: a sheet detecting unit arranged in a sheet transport path for transporting the sheet and adapted to detect the sheet; and a control unit which, when the tabbed sheet is made to travel, performs control so as to make a set value for a reference timer for a jamming judgment to be made through detection of a sheet by the sheet detecting unit different from a set value for an ordinary sheet.

Further, according to another aspect of the present invention, in the image forming apparatus, when the tabbed sheet is made to travel reversely, the stop timing for a reversing roller is delayed as compared with that for an ordinary sheet.

Furthermore, according to another aspect of the present invention, in the image forming apparatus, when the stop timing for the reversing roller is delayed as compared with that for the ordinary sheet, control is performed such that the reference timer value for jamming detection after the reversing is larger than the traveling time value corresponding to the length of the tab.

As described above, in accordance with this invention, it is possible to provide an image forming apparatus capable of transporting a tabbed sheet, including a sheet detecting unit arranged in a sheet transport path for transporting a sheet and adapted to detect the sheet, and a control unit which when a tabbed sheet is transported, performs control so as to make the set value of a reference timer for judging jamming upon sheet detection by the sheet detecting unit different from the set value for ordinary sheets, whereby even when a tabbed sheet is transported, no erroneous jamming detection occurs, making it possible for a tabbed sheet to be transported in the same manner as in the case of an ordinary sheet.

BRIEF DESCRIPTION OF THE DRAWING

Preferred embodiments of this invention will be described in detail based on the following figures, wherein.

DETAILED DESCRIPTION OF THE PREFFERRED EMBODIMENT

Embodiments of this invention will now be described with reference to the drawings.

Embodiment 1

Figure 2:
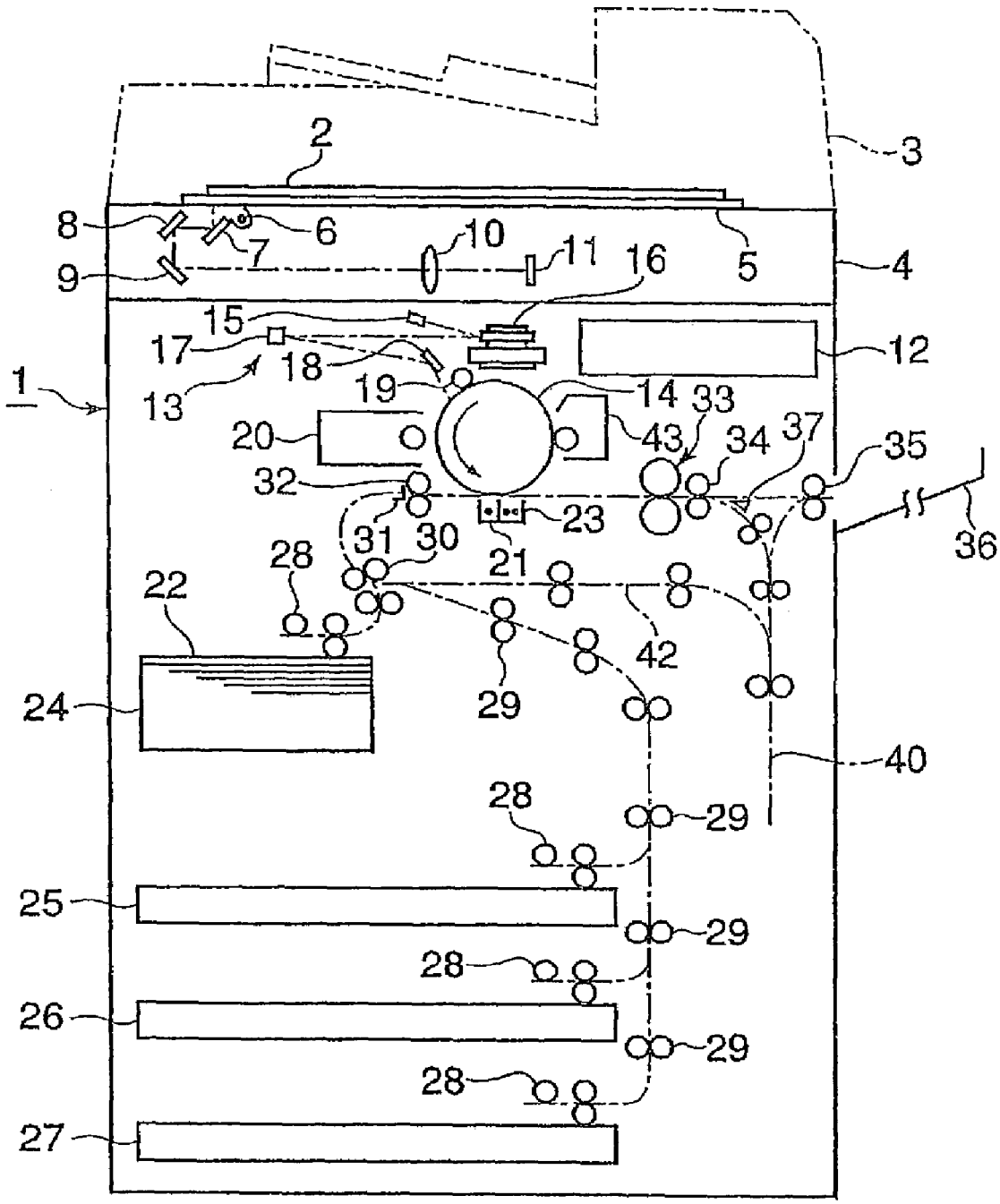
FIG. 2 is a diagram showing the construction of a digital copying machine as the image forming apparatus according to Embodiment 1 of this invention.

FIG. 2 shows a digital copying machine as an image forming apparatus according to Embodiment 1 of this invention.

In FIG. 2, reference numeral 1 indicates a main body of the digital copying machine. In an upper portion of the digital copying machine main body 1, there are arranged an automatic document feeder (ADF) 3 for automatically transporting originals 2 one by one, and an image reader 4 for reading the images of the originals 2 transported by the automatic document feeder 3. In the image reader 4, the original 2 placed on a platen glass 5 is illuminated by a light source 6. And, in the image reader 4, the reflected optical image from the original 2 is scanned and exposed by way of a reduction optical system formed by a full rate mirror 7, half rate mirrors 8 and 9, and a lens 10 on an image reading device formed of a CCD or the like, whereby the image of the original 2 is read.

The image information of the original 2 read by the image reader 4 is stored in a temporary storage device (not shown) Further, a predetermined image processing is performed as needed by an IPS (image processing system) 12. Thereafter, according to the image information that has undergone image processing, image exposure is effected on a photosensitive drum 14 by a ROS (raster output scanner) 13. As a result, an electrostatic latent image is formed on the photosensitive drum 14. The ROS 13 is composed of a semiconductor laser 15 for emitting a laser beam according to image information, a polygon mirror 16 for scanning the laser beam emitted from the semiconductor laser 15, and mirrors 17 and 18 for applying the laser beam scanned by the polygon mirror 16 to the photosensitive drum 14 for exposure. Prior to the image exposure by the ROS 13, the photosensitive drum 14 is uniformly charged to a predetermined potential of a predetermined polarity by a primary charger 19 formed by a charging roller. Thereafter, as stated above, the image of the original 2 is exposed on the photosensitive drum 14 by the ROS 13 to thereby form an electrostatic latent image. The electrostatic latent image formed on the photosensitive drum 14 is developed by a developing device 20 into a toner image. This toner image is transferred to a recording sheet 22 through charging by a transfer corotron 21. The recording sheet 22 to which the toner image has been transferred is separated from the photosensitive drum 14 through charge elimination of a separation corotron 23. The recording sheet 22 to which the toner image is transferred from the photosensitive drum 14 is fed by a feeding roller 28 from one of plural sheet feeding trays 24, 25, 26, and 27 arranged inside the copying machine main body 1. Further, the recording sheet 22 is temporarily transported to a registration gate 31 by way of a transport roller 29 and a pre-registration roller 30 and stopped there. And, the recording sheet 22 passes the registration gate 31, which is opened in synchronism with the toner image formed on the surface of the photosensitive drum 14. Thereafter, the recording sheet 22 is transported to the surface of the photosensitive drum 14 by registration rollers 32 arranged on the downstream side of the registration gate 31. And, as stated above, after the toner image formed on the surface of the photosensitive drum 14 has been transferred thereto, the recording sheet 22 is separated from the surface of the photosensitive drum 14.

The recording sheet 22 separated from the surface of the photosensitive drum 14 is transported to a fixing device 33. And, in the fixing device 33 the toner image is fixed to the recording sheet 22 by the application of heat or pressure. In the case of usual, one-side copying, the recording sheet 22 to which the toner image has been fixed is conveyed as it is by outlet rollers 34 of the fixing device 33 and discharged onto a discharge tray 36 outside the machine by discharge rollers 35. In the case of double-side copying, the recording sheet 22 to which the toner image has been fixed to one side thereof is not discharged as it is to the exterior of the machine by the discharge rollers 35. The transport direction of the recording sheet 22 is shifted downwardly by a reversing gate 37, and the sheet is temporarily transported to a reversing path 40 by transport rollers 38 formed by two rollers in press contact with each other, and first and second reversing roller pairs 39 and 41. And, the recording sheet 22 is transported to a double-side copying path 42 by the second reversing rollers 39 rotating reversely this time. Thereafter, the recording sheet 22 is temporarily transported to the registration gate 31 from the double-side copying path 42 through the pre-registration rollers 30 and is stopped there. And, as stated above, the recording sheet 22 is transported by the registration gate 31 and the registration rollers 32 in synchronism with the toner image on the photosensitive drum 14, and the transfer and fixing of the toner image is effected. Thereafter, the recording sheet 22 is discharged onto the discharge tray 36 by the discharge rollers 35.

After the completion of the transfer of the toner image, residual toner, paper dust, etc. on the surface of the photosensitive drum 14 are removed by a cleaning device 43 to make the apparatus ready for the next image forming process.

Figure 3:
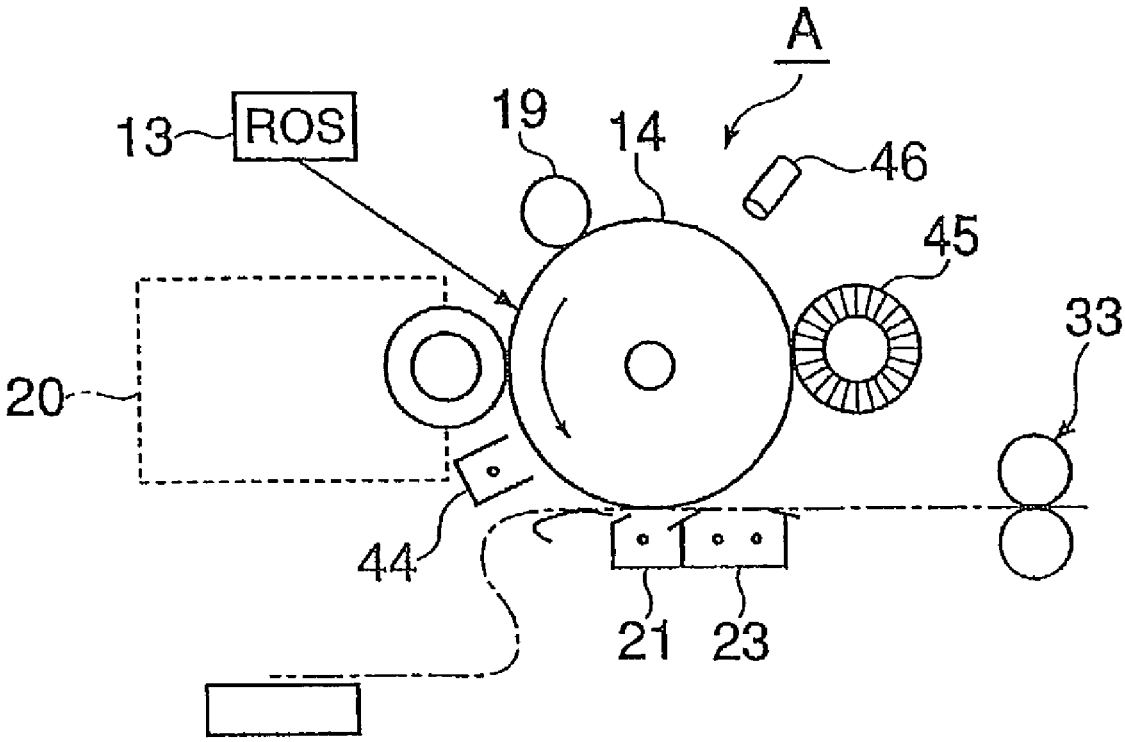
FIG. 3 is a schematic diagram showing an image forming portion.

FIG. 3 is an enlarged view of the image recording portion A of the digital copying machine constructed as described above.

The photosensitive drum 14 is charged uniformly to a predetermined potential of a predetermined polarity by the primary charger 19 formed by a charging roller. Thereafter, the image of the original 2 is scanned and exposed on the surface of the photosensitive drum 14 by the ROS 13 to form an electrostatic latent image. The electrostatic latent image formed on the photosensitive drum 14 is developed by the developing device 20 to become a toner image. This toner image is subjected to auxiliary charging by a pre-transfer charger 44. Thereafter, as stated above, the toner image is transferred through charging of the transfer corotron 21 onto the recording sheet 22, which is fed and transported from a desired one of the sheet feeding trays 24 through 27. And, the recording sheet 22 to which the toner image has been transferred is separated from the photosensitive drum 14 through charge elimination by the separation corotron 23. The recording sheet 22 separated from the photosensitive drum 14 is transported to the fixing device 33. In the case of one-side copying, the recording sheet 22 to which the toner image has been fixed by the fixing device 33 is discharged as it is onto the discharge tray 36. In the case of double-side copying, the image forming process is performed again on the back side.

After the completion of the toner image transfer process, residual toner, paper dust, etc. on the surface of the photosensitive drum 14 are removed by a cleaning brush 45 or the like of the cleaning device 43. Thereafter, the photosensitive drum is subjected to exposure by an erase lamp 46 to eliminate the residual charge, making the apparatus ready for the next image forming process.

Figure 4:
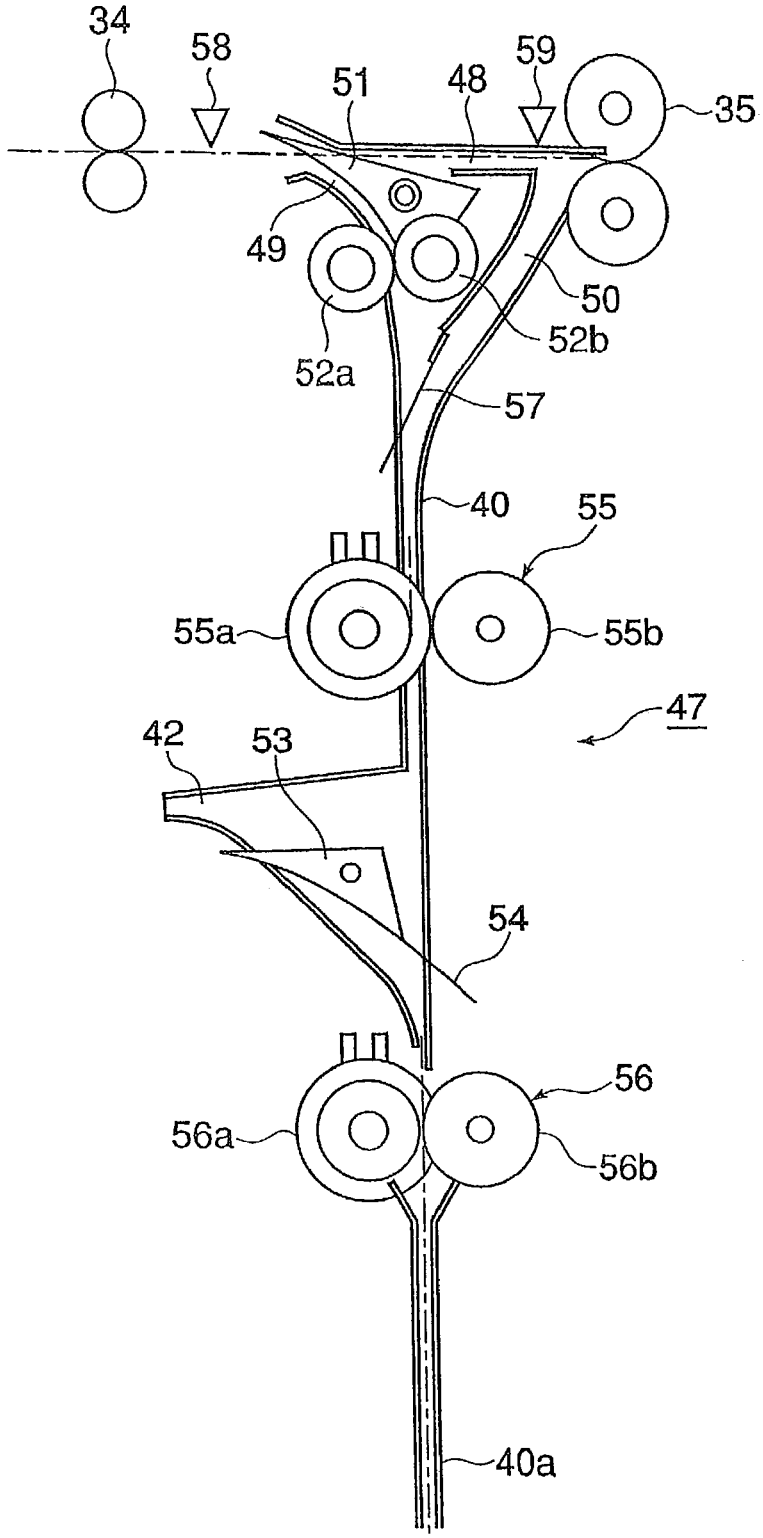
FIG. 4 is a schematic diagram showing a sheet reversing mechanism.

FIG. 4 shows the image reversing mechanism of the above-described image forming apparatus.

In FIG. 4, reference numeral 47 indicates a sheet reversing mechanism provided in the discharge portion of the above image forming apparatus. Between the transport rollers 34 and the discharge rollers 35 of the fixing device 33 of the image forming apparatus, there is formed a linear discharge path 48 extending substantially in the horizontal direction. Below the discharge path 48, there are formed a bring-in path 49 obliquely extending downwards from the upstream side of the discharge path 48 with respect to the direction in which the recording sheet 22 is transported and a send-out path 50 obliquely extending downwards from the downstream side of the discharge path 48 with respect to the direction in which the recording sheet 22 is transported, the two paths substantially forming an triangle. Arranged at the inlet portion of the discharge path 48 and the bring-in path 49 is a switching gate 51 for switching the recording sheet 22 discharged from the fixing device 33 between the discharge path 48 side and the bring-in path 49 side. This switching gate 51 can be inclined by a solenoid or the like (not shown). Below the joining position where the bring-in path 49 and the send-out path 50 join together, there is arranged a first shield plate 57 formed of a synthetic resin film such as a Mylar sheet. This first shield plate 57 is arranged so as to establish communication between the send-out path 50 and a reversing path 40.

Further, in the bring-in path 49 of the sheet reversing mechanism 47, there is arranged a transport roller pair 52 constituting a part of the sheet reversing mechanism 47. This transport roller pair 52 is arranged such that the nip portion between a driven roller **52*a* and a driving roller 52*b* is situated in the bring-in path 49. Further, the transport roller pair 52 is arranged in a state in which the driven roller 52*a* and the driving roller 52*b*** are held in press contact with each other.

Further, as shown in FIG. 4, the reversing path 40 extends from the lower end of the joining portion where the bring-in path 49 and the send-out path 50 join together. This reversing path 40 extends downwards. Further, the reversing path 40 is downwardly branched into a recessed portion **40*a* extending vertically downwards and a double-side/multiple recording path 42. At the branching portion between the recessed portion 40*a* and the double-side/multiple recording path 42, there is arranged a switching member 53 for switching the direction in which the recording sheet 22 is transported. From the lower end portion of the switching member 53, there protrudes downwardly a second shield plate 54 formed of a synthetic resin film such as a Mylar sheet. The second shied plate 54 is normally disposed at a position shown in the drawing. In the reversing path 40, there are arranged first reciprocally rotatable rollers 55 for transporting the recording sheet 22. The first reciprocally rotatable rollers 55 are composed of a reciprocally rotatable roller 55*a* and a pinch roller 55*b*. The pinch roller 55*b* can be released from the press contact with the reciprocally rotatable roller 55*a* by a solenoid through a link (not shown). Further, in the recessed portion 40*a* also, a reciprocally rotatable roller 56*a* and a pinch roller 56*b* for transporting the recording sheet 22 are arranged so as to be capable of being held in press contact with each other. The pinch roller 56*b* can be released from the press contact with the reciprocally rotatable roller 56*a*** by a solenoid through a link (not shown).

Further, as shown in FIG. 4, in the sheet reversing mechanism 47, there is arranged at a reference detection portion on the output side of the transport rollers 34 a first sheet detecting unit 58 for detecting the sheet 22. Further, at a discharge detection portion on the input side of the discharge rollers 35, there is arranged a second sheet detecting unit 59 for detecting the sheet 22. The first and second sheet detecting units 58 and 59 may be any type of systems, for example, ones which optically detect the sheet 22 or ones which mechanically detect the sheet 22.

In the sheet reversing mechanism 47 constructed as described above, the sheet reversing operation is conducted as follows.

When the image forming apparatus is in the mode for one-side copying and normal discharge, the driving motor for driving the transport roller pair 52 of the sheet reversing mechanism 47 is at rest. And, as shown in FIG. 4, in a state in which the switching gate 51 arranged at the inlet portion of the discharge path 48 is lowered, the recording sheet 22 which has undergone fixing in the fixing device 33 passes above the switching gate 51 through the discharge path 48 and is discharged as it is to the exterior of the apparatus from the discharge rollers 35.

When the image forming apparatus is in the mode for one-side copying and reversed discharge, the driving motor for driving the driving roller 52*b* of the transport roller pair 52 of the sheet reversing mechanism 47 is driven. And, the driving roller 52*b* and the driven roller 52*a* of the transport roller pair 52 are rotated. As shown in FIG. 4, the switching gate 51 arranged in the discharge path 48 is raised by a solenoid (not shown). As a result, the switching gate 51 is switched from the discharge path 48 side to the bring-in path 49 side. And, the recording sheet 22 which has undergone fixing in the fixing device 33 is changed in transport direction by the switching gate 51 and transported to the bring-in path 49. Further, the recording sheet 22 is guided to the nip portion formed by the driven roller 52*a* and the driving roller 52*b* situated in the bring-in path 49. And, the recording sheet 22 is guided to the first and second reciprocally rotatable roller pairs 55 and 56 in normal rotation through the reversing path 40 by the driving force of the driving roller 52*b*. As a result, the recording sheet 22 is temporarily guided into the reversing path 50. At this time, the upper end portion of the recording sheet 22 is situated above the lower end portion of the shield plate 54 of the switching member 53.

And, the recording sheet 22 temporarily guided into the reversing path 40 by the first and second reciprocally rotatable roller pairs 55 and 56 is transported again into the reversing path 40 by the reversely rotating second reciprocally rotatable roller pair 56. This is because the upper end portion of the recording sheet 22 is situated above the lower end portion of the shield plate 54 of the switching member 53. Thereafter, the recording sheet 22 is transported through the reversing path 40 to the discharge rollers 35 by the first reciprocally rotatable roller pair 55 arranged in the reversing path 40. After the recording sheet 22 is transported by the discharge rollers 35 and the lower end portion of the recording sheet 22 has passed the second reciprocally rotatable roller pair 56, the nipping of the first reciprocally rotatable roller pair 55 is canceled. Further, the discharge rollers 35 are accelerated to quickly discharge the recording sheet 22.

When the image forming apparatus is in the double-side copying mode, the driving motor for driving the driving roller 52*b* of the transport roller pair 52 of the sheet reversing mechanism 47 is driven. As a result, the driving roller 52*b* and the driven roller 52*a* of the transport roller pair 52 are driven. Further, as shown in FIG. 4, the switching gate 51 arranged in the discharge path 48 is raised by a solenoid (not shown). And, the switching gate 51 is switched from the discharge path 48 side to the bring-in path 49 side. And, the recording sheet 22 is guided to the first and second reciprocally rotatable roller pairs 55 and 56 in normal rotation in the same manner as in the case of the mode for one-side copying and reversed discharge. Next, the timing with which the recording sheet 22 is reversed is delayed as compared with that in the case of the mode for one-side copying and reversed discharge. Then, the upper end portion of the recording sheet 22 passes the shield plate 54 mounted to the lower end portion of the switching member 53. In the process, the switching member 53 is switched to the double-side/multiple recording path 42 side by its own weight. Thus, the recording sheet 22 transported again by the second reciprocally rotatable roller pair 56 in reverse rotation is transported to the double-side/multiple recording path 42 through the switching member 53, with the surface with the toner image formed thereon facing upwards. The recording sheet 22 is again transported to the image forming portion through the double-side/multiple recording path 42, curved and bent back, with the surface with the toner image formed thereon facing downwards. And, a toner image is formed on the back side of the recording sheet 22. The operation to be conducted after this is the same as that in the mode for one-side copying and normal discharge. The recording sheet 22 with toner images formed on both sides thereof passes the fixing device 33, and then discharged to the exterior of the apparatus through the discharge path 48 by the discharge rollers 35.

When this embodiment is applied to an image forming apparatus which allows transport of a tabbed sheet having a tab protruding from an end edge thereof and which has a sheet detecting unit for detecting sheets that is arranged in the sheet transport route, there is provided a control unit for performing control such that when a tabbed sheet is to be transported, the set value for a reference timer for judgment of jamming through detection of a sheet by the sheet detecting unit is made different from the set value for ordinary sheets.

Further, in this embodiment, the control unit performs control such that when a tabbed sheet is to be transported, the set value for a reference timer for judgment of jamming through detection of a sheet by the sheet detecting unit is made larger than the set value for ordinary sheets.

Further, in this embodiment, the change of the set value for the reference timer is effected according to the traveling position of the tab of the tabbed sheet and with respect to the set value for at least one of the leading and trailing ends of the sheet.

Figure 5:
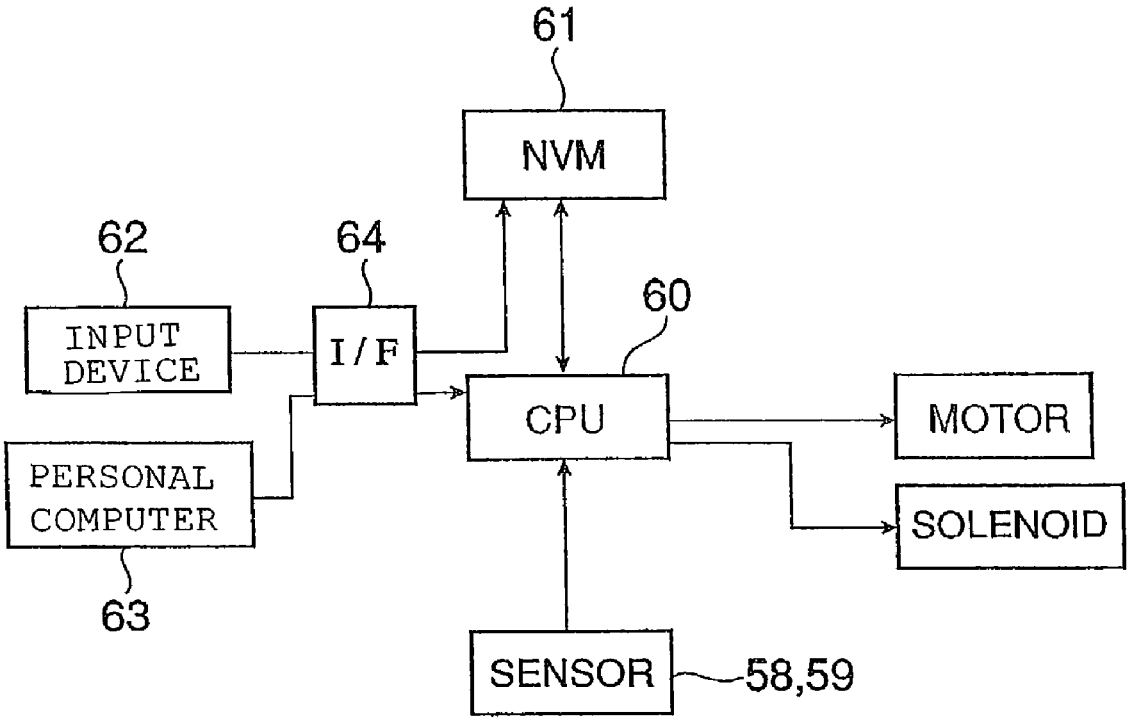
FIG. 5 is a block diagram showing a control circuit.

FIG. 5 is a block diagram showing the control circuit of an image forming apparatus according to Embodiment 1 of this invention.

In FIG. 5, reference numeral 60 indicates a CPU for controlling the operation of the image forming apparatus. When a tabbed sheet is made made to travel, this CPU 60 also functions as a control unit for performing control such that the set value for a reference timer for judgment of jamming through detection of a sheet by the sheet detecting unit is made different from the set value for ordinary sheets. Parameters, etc. to be used for control in the CPU 60 are stored in an NVM 61. Further, various items of data for image formation, such as sheet sizes and sheet types, are input to the CPU 60 and the NVM 61. The various items of data are input from an input device 62, such as a user interface, a personal computer 63, etc. through an interface (I/F) 64. Further, signals are input to the CPU 60 from sheet detecting units 58 and 59. Further, signals are transmitted from the CPU 60 to a motor, solenoid, etc. for driving the sheet transport system to thereby control the motor, solenoid, etc.

In the above-described image forming apparatus according to Embodiment 1 capable of transporting a tabbed sheet, even when a tabbed sheet is transported, erroneous jamming detection is prevented as follows, allowing a tabbed sheet to travel in the same manner as an ordinary sheet.

Figure 1:
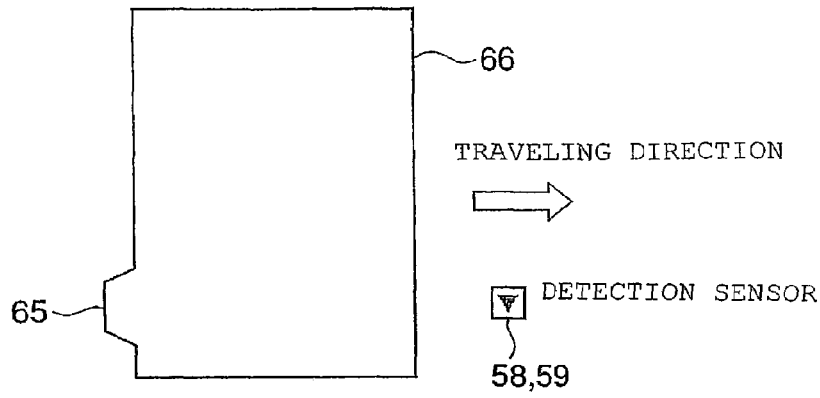
FIGS. 1A and 1B are an explanatory diagram showing how a tabbed sheet is transported in an image forming apparatus according to Embodiment 1 of this invention and a timing chart showing how a tabbed sheet is transported.
Figure 1:
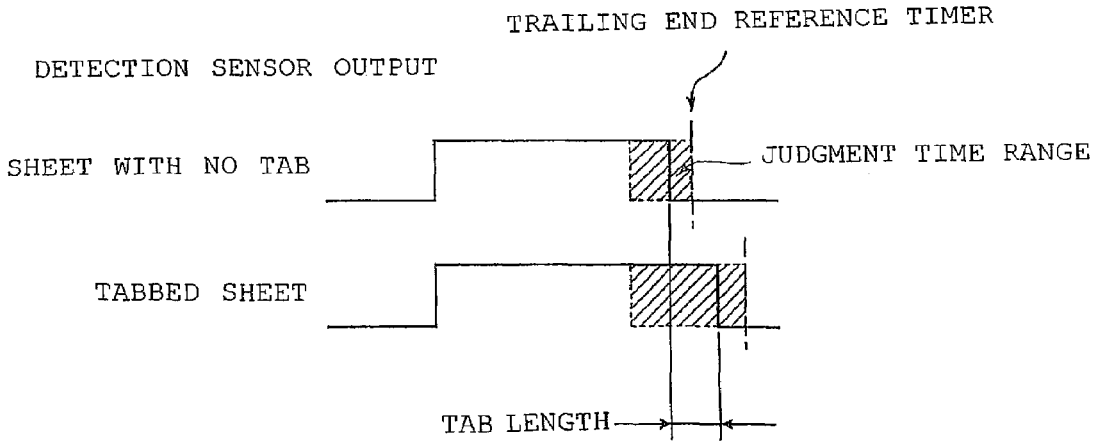

That is, as shown in FIG. 1, in the above-described image forming apparatus, a tabbed sheet 66 which is a sheet equipped with a trapezoidal or rectangular tab 65 protruding from a part of an end edge of the sheet 22 can be made to travel. The tabbed sheet 66 is accommodated, for example, in one of the sheet feeding trays 24 through 27. The tabbed sheet 66 allows image formation not only on the surfaces of the sheet but also on the tab 65 (both sides thereof) as needed.

In the above image forming apparatus, when the tabbed sheet 66 is to be transported, one of the sheet feeding trays 24 to 27 to accommodate the tab 66 and the traveling condition for the tab 66 are designated. As shown in FIG. 5, the designation is effected from an input device 62 formed by the user interface or the like of the image forming apparatus, the print interface of another personal computer 63, etc. Examples of the traveling condition to be designated include: the bring-in position for the tab 66 in the job, selection between one-side and double-side printing on the tab 65 of the tabbed sheet 66, the tab position at the time of discharge (at the leading end or the trailing end of the sheet), and the tab 65 with respect to the tabbed sheet 66. Further, to enable a tabbed sheet 66 of a special configuration to be transported, it is possible to input tab size (length in the transport direction), etc. as needed.

And, when the apparatus is in the tabbed sheet mode in which the tabbed sheet 66 is to be transported, the CPU 60 changes the value of a reference timer for jamming judgment to be made by the detecting units 58 and 59 such as sensors arranged in the sheet transport path to a predetermined value on the basis of data stored in the NVM 61.

Figure 6:
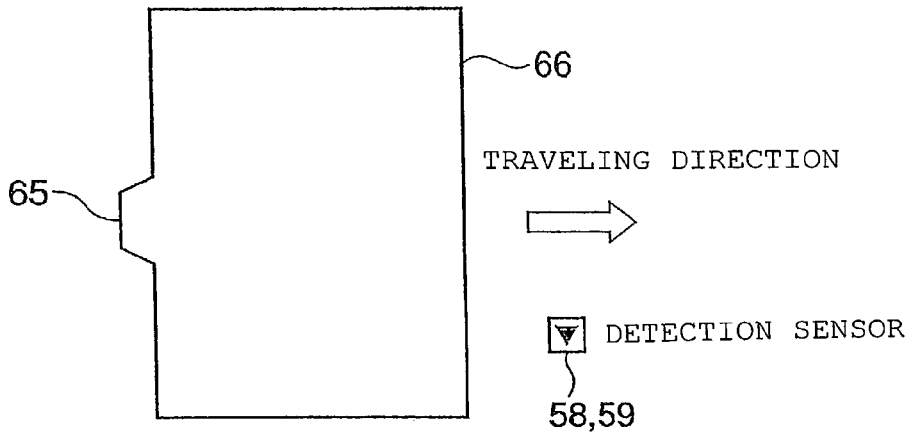
FIGS. 6A and 6B are an explanatory diagram showing how a tabbed sheet is transported in the image forming apparatus according to Embodiment 1 of this invention and a timing chart showing how a tabbed sheet is transported.
Figure 6:
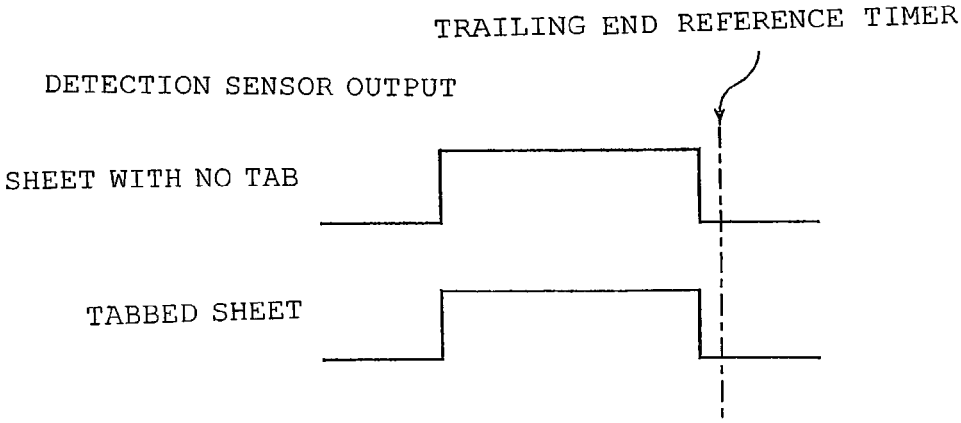

In the process, when, as shown in FIG. 6A, the sheet to be transported is a tabbed sheet 66 but has the tab 65 at the trailing end of the sheet that does not pass the sheet detecting units 58 and 59 installed in the image forming apparatus, the CPU 60 operates as follows. That is, as shown in FIG. 6B, the CPU 60 executes image forming operation, with the detection start timing and the detection end timing of the sheet detecting units 58 and 59 being set to values that are the same as those of an ordinary sheet 22 with no tab 65.

In contrast, when, as shown in FIG. 1A, the sheet to be transported is a tabbed sheet 66 and has the tab 65 at the trailing end of the sheet that passes the sheet detecting units 58 and 59 installed in the image forming apparatus, the CPU 60 operates as follows. That is, when, as shown in FIG. 1B, the ordinary reference timer for determining the detection end timing for the sheet detecting units 58 and 59 is set in the same manner as in the case of an ordinary sheet, the CPU 60 erroneously determines that jamming has occurred. The reason for this is as follows. In the case of the tabbed sheet 66, the detection end timing for the sheet detecting units 58 and 59 is delayed by the tab traveling time, so that when the trailing end reference timer expires, the tab 65 of the tabbed sheet 66 is still passing the sheet detecting units 58 and 59.

In view of this, in this embodiment, to prevent erroneous jamming detection due to the tabbed sheet 66, the following operation is performed. That is, when it is determined that the sheet made to travel is the tabbed sheet 66 and that the tab 65 is at the trailing end of the sheet passing the sheet detecting units 58 and 59 installed in the image forming apparatus, the CPU 60 performs control such that, as shown in FIG. 1B, the jamming reference timer value of the sheet trailing end is increased by the tab traveling time. This control is effected based on data stored in the NVM 61 when the tabbed sheet 66 is designated.

Figure 7:
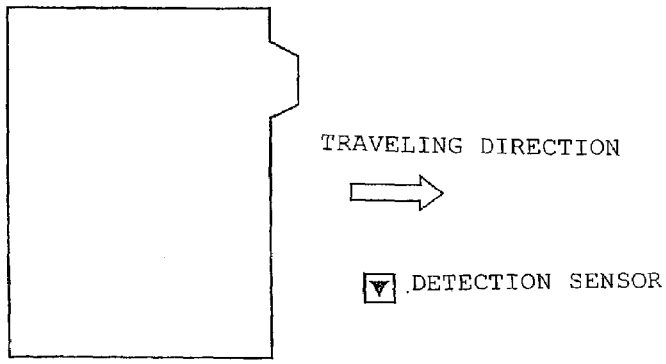
FIGS. 7A and 7B are an explanatory diagram showing how a tabbed sheet is transported in the image forming apparatus according to Embodiment 1 of this invention and a timing chart showing how a tabbed sheet is transported.
Figure 7:
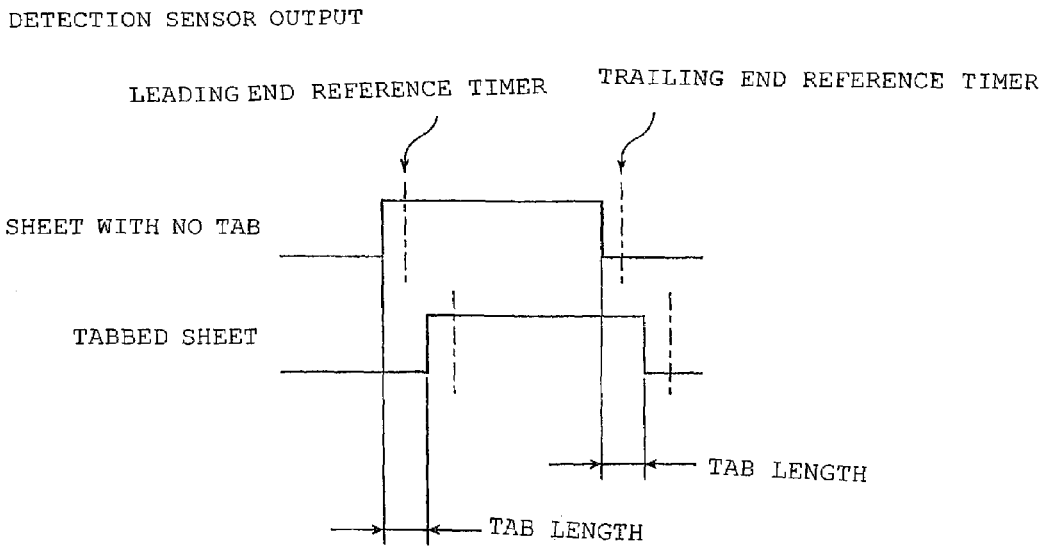
Figure 8:
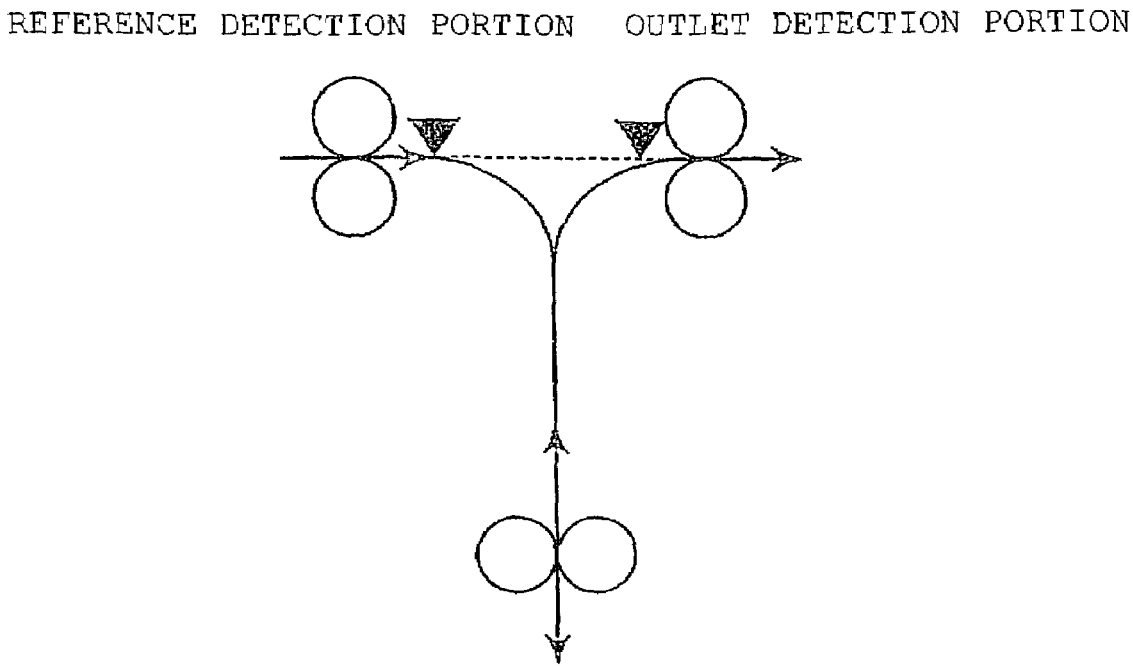
FIG. 8 is a schematic diagram showing a sheet reversing mechanism.

On the other hand, when, as shown in FIG. 7A, the sheet made to travel is the tabbed sheet 66 and the tab 65 is at the leading end of the sheet which does not pass the sheet detecting units 58 and 59 installed in the image forming apparatus, the CPU 60 operates as follows. That is, when the tab 65 is at the leading end of the sheet which does not pass the sheet detecting units 58 and 59 installed in the image forming apparatus, the detection start timing of the sheet detecting units 58 and 59 is delayed by the tab traveling time, and the detection end timing is also delayed by the tab traveling time. Thus, when the tabbed sheet 66 is designated, the CPU 60 performs control so as to increase the jamming reference timer values for the leading and trailing ends of the sheet by the tab traveling time, as shown in FIG. 7B. This control is performed for the purpose of preventing erroneous jamming detection.

In this way, in the above embodiment, the jamming reference timer value is changed to prevent jamming of a tabbed sheet. However, in a jamming judgment system in which a judgment is made as to whether the output signals from the sheet detecting units 58 and 59 have been changed in a fixed period of time, it is only necessary to increase the judgment time by the tab traveling time as indicated by the shaded portions in FIG. 1B. That is, in the system in which a judgment as to whether the output signals from the sheet detecting units 58 and 59 have been changed is made exclusively for a fixed period of judgment time, the judgment time is shifted backwards by the length of the tab.

FIGS. 8 and 9A to 9C show a control operation in which the drive portion is stopped using the trailing end of the sheet 22 as a reference, causing the tabbed sheet 66 to travel to the sheet reversing mechanism 47 of the type which reverses the sheet 22.

As shown in FIG. 4, in the sheet reversing mechanism 47, after the trailing end of the sheet 22 has passed the reference detecting portion, the driving portions of the first and second reciprocally rotatable roller pairs 55 and 56 are stopped with a fixed timing, and then the driving portions are reversely driven to thereby reverse the sheet 22.

In the case of FIG. 7A, in which the tabbed sheet 66 enters with the tab 65 at the forward end thereof, the tabbed sheet 66 is reversed and discharged by the same control operation as in the case of the sheet 22 with no tab. Whereas, in the case in which, as shown in FIG. 6A, the tabbed sheet 66 enters the reversing portion with the tab 65 at the trailing end thereof, the sheet stop position is the same as that for the ordinary sheet unless the tab 65 reaches the reference detecting portion, so that the tab 65 cannot pass the reversing gate 54 and is caught.

Figure 9:
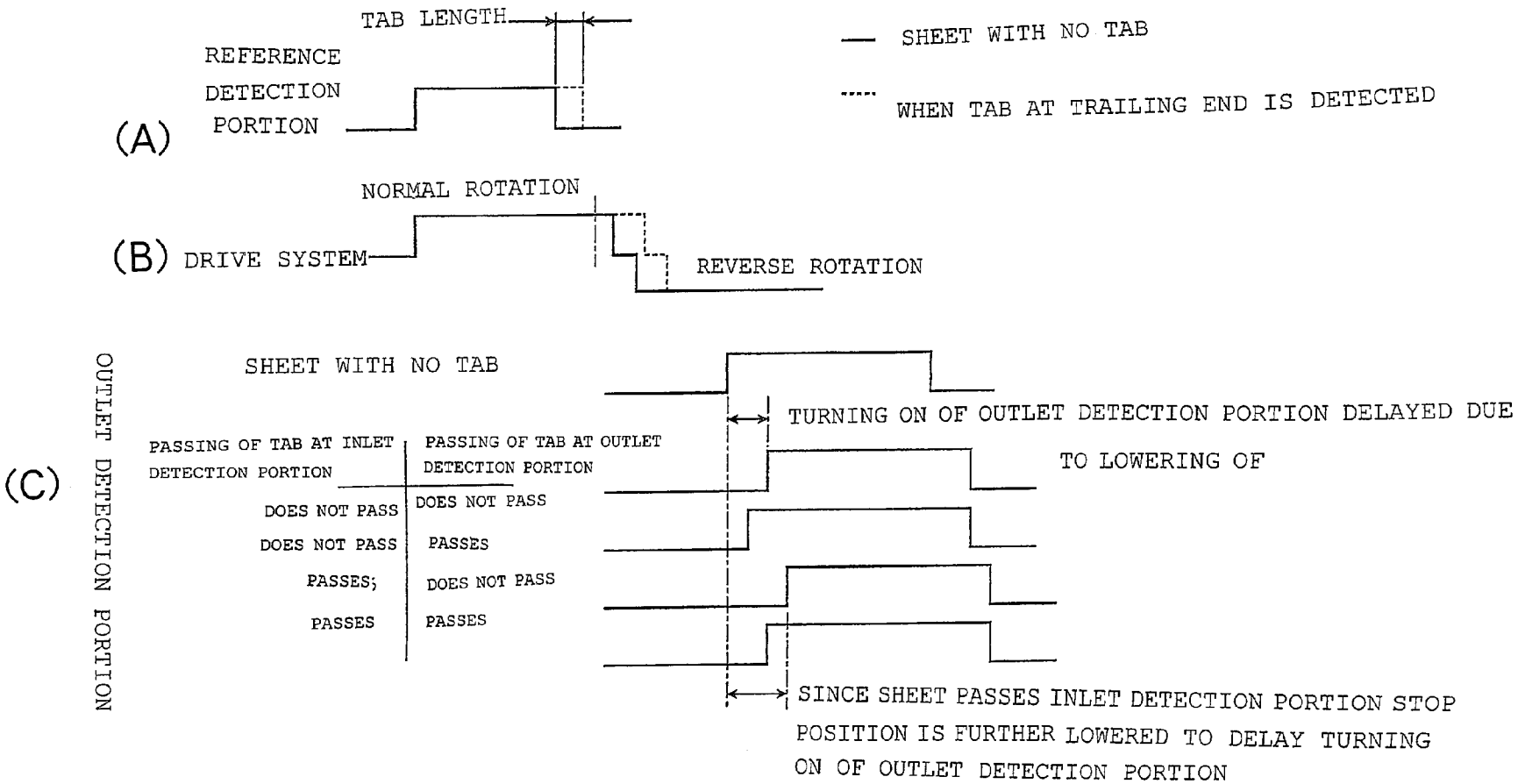
FIGS. 9A, 9B, and 9C are a timing chart showing the operation of a reference detecting portion, a timing chart showing the operation of a drive system, and an explanatory diagram including a timing chart showing how a tabbed sheet is transported.

Thus, when the tabbed sheet 66 is selected and the position of the tab 65 is designated to be at the trailing end of the sheet, the CPU 60 operates as follows. That is, as shown in FIG. 9A, the CPU 60 delays the sheet drive stop timing in the reversing portion by the traveling time of the tab 65. In this control, however, the sheet stop position is shifted by the length of the tab 65. For, when the tab 65 of the tabbed sheet 66 passes the reference detection portion, the first and second reciprocally rotatable roller pairs 55 and 56 are stopped in a predetermined time after the detection of the trailing end of the tab 65 by the reference detection portion.

Thus, when the drive stop timing is delayed, the CPU 60 performs control so as to make the jamming detection reference timer value or the judgment time after the reversal longer than the traveling time corresponding to the length of the tab 65.

More specifically, at the outlet detection portion of the sheet reversing mechanism 47, control is performed as shown in FIG. 9C. That is, in the case of an ordinary sheet with no tab, the leading end and the trailing end of the sheet 22 are detected with a predetermined timing. In the case of the tabbed sheet 66, however, the stop position at the time of reversal of the tabbed sheet 66 is lowered as described above, so that the turning on of the outlet detection portion is delayed. As shown'in FIG. 9C, a difference is generated in this delay of the turning on of the outlet detection portion depending on whether the tab 65 passes the sheet detecting unit 59 or not.

Thus, taking into account this difference, the CPU 60 performs control so as to make the set value of the reference timer for jamming judgment different.

In this way, in the above embodiment, when the tabbed sheet 66 is made to travel, the CPU 60 performs control so as to make the set value of the reference timer for jamming judgment to be made through detection of the sheet 22 by the sheet detecting units 58 and 59 different from the set value for the ordinary sheet. Due to this arrangement, in an image forming apparatus capable of transporting a tabbed sheet 66, even when a tabbed sheet 66 is transported, no erroneous jamming detection occurs, making it possible for the tabbed sheet 66 to be transported in the same manner as in the case of an ordinary sheet.

What is claimed is:

1. An image forming apparatus allowing travel of a tabbed sheet equipped with a tab protruding from an end edge thereof, comprising:

a sheet detecting unit arranged in a sheet transport path for transporting the sheet and adapted to detect the sheet; and a control unit which, when the tabbed sheet is made to travel, performs control so as to make a set value for a reference timer for a jamming judgment to be made through detection of a sheet by the sheet detecting unit different from a set value for an ordinary sheet.

2. An image forming apparatus according to claim 1, wherein, when the tabbed sheet is made to travel, the control unit performs control so as to make the set value for the reference timer for the jamming judgment to be made through detection of a sheet by the sheet detecting unit larger than the set value for the ordinary sheet.

3. An image forming apparatus according to claim 1, wherein the change of the set value for the reference timer is effected on the set value for at least one of a leading end and a trailing end of the sheet according to the traveling position of the tab of the tabbed sheet.

4. An image forming apparatus according to claim 1, wherein, when the tabbed sheet is made to travel reversely, the stop timing for a reversing roller is delayed as compared with that for an ordinary sheet.

5. An image forming apparatus according to claim 4, wherein, when the stop timing for the reversing roller is delayed as compared with that for the ordinary sheet, control is performed such that the reference timer value for jamming detection after the reversing is larger than the traveling time value corresponding to the length of the tab.

* * * * *